US008537068B2

(12) United States Patent
Martin et al.

(10) Patent No.: US 8,537,068 B2
(45) Date of Patent: Sep. 17, 2013

(54) METHOD AND APPARATUS FOR TRI-BAND FEED WITH PSEUDO-MONOPULSE TRACKING

(75) Inventors: Larry C. Martin, Los Angeles, CA (US); Yueh-Chi Chang, Northborough, MA (US); John J. Hanlin, Worcester, MA (US); William F. Call, Milford, MA (US)

(73) Assignee: Raytheon Company, Waltham, MA (US)

( * ) Notice: Subject to any disclaimer, the term of this patent is extended or adjusted under 35 U.S.C. 154(b) by 556 days.

(21) Appl. No.: 12/693,494

(22) Filed: Jan. 26, 2010

(65) Prior Publication Data

US 2011/0181479 A1 Jul. 28, 2011

(51) Int. Cl.
*H01Q 13/00* (2006.01)

(52) U.S. Cl.
USPC ..... 343/786; 343/785

(58) Field of Classification Search
USPC ..... 343/786, 785, 772
See application file for complete search history.

(56) References Cited

U.S. PATENT DOCUMENTS

| | | | | |
|---|---|---|---|---|
| 5,036,332 | A | 7/1991 | Thomas | |
| 5,041,840 | A | 8/1991 | Cipolla et al. | |
| 5,047,738 | A | 9/1991 | Wong et al. | |
| 5,304,998 | A | 4/1994 | Lopez | |
| 6,208,308 | B1 | 3/2001 | Lemons | |
| 6,232,849 | B1 * | 5/2001 | Flynn et al. | 333/26 |
| 6,501,433 | B2 | 12/2002 | Popa et al. | |
| 6,667,722 | B1 | 12/2003 | Schmidt et al. | |
| 6,720,932 | B1 * | 4/2004 | Flynn et al. | 343/786 |
| 7,034,774 | B2 | 4/2006 | Kuo et al. | |
| 7,202,832 | B2 | 4/2007 | Wang | |
| 7,391,381 | B2 | 6/2008 | Wang et al. | |
| 7,397,323 | B2 | 7/2008 | Tavassoli Hozouri | |
| 7,511,678 | B2 | 3/2009 | Wu | |
| 7,602,347 | B2 * | 10/2009 | Flynn et al. | 343/786 |
| 2004/0036661 | A1 | 2/2004 | Hanlin et al. | |
| 2008/0122683 | A1 | 5/2008 | Howley et al. | |

FOREIGN PATENT DOCUMENTS

| | | |
|---|---|---|
| JP | 60018004 | 1/1985 |
| WO | WO 00/41266 | 7/2000 |

OTHER PUBLICATIONS

J.R. James and P.S. Hall, Handbook of Microstrips Antennas, pp. 860-861, 1989.

Notification of transmittal of the International Search Report dated May 19, 2011, PCT/US2011/021989.

The International Search Report dated May 19, 2011, PCT/US2011/021989.

Written Opinion of the International Searching Authority dated May 19, 2011, PCT/US2011/021989.

PCT International Preliminary Report on Patentability of the ISR dated Aug. 9, 2012; for PCT Pat. App. No. PCT/US2011/021989; 2 pages.

PCT Written Opinion of the ISR dated Aug. 9, 2012; for PCT Pat. App. No. PCT/US2011/021989; 6 pages.

* cited by examiner

*Primary Examiner* — Hoanganh Le
(74) *Attorney, Agent, or Firm* — Daly, Crowley, Mofford & Durkee, LLP

(57) ABSTRACT

Methods and apparatus for a feed assembly for a reflector antenna including an aperture common to low, mid, and high frequency bands, a polyrod design to launch signals in the mid and high frequency bands, a horn to launch signals in the low frequency band, a co-located phase center for launching signals in the low, mid, and high frequency bands, and a low-band monopulse array located on a surface about the aperture to track a satellite.

20 Claims, 13 Drawing Sheets

METHOD AND APPARATUS FOR TRI-BAND FEED WITH PSEUDO-MONOPULSE TRACKING

BACKGROUND

Conventional SATCOM terminals utilize mechanical means for satellite tracking, such as gimbal scan or CONSCAN with a rotating subreflector. However, for COTM (Communication On The Move) applications, random perturbations such as those due to rapid vehicle movement over tough terrain will degrade the tracking accuracy to an unacceptable level.

Prior attempts for SATCOM electronic tracking include a dual-band tracking feed, using higher order modes to form azimuth and elevation difference patterns, a dual-band feed with electronic tracking capability using a TEM coaxial mode to receive a θ varying error signal, and a monopulse implemented using a single band horn with higher order modes. In general such systems utilize large mode couplers and cannot be applied to a multi-band aperture. These systems offer pseudo-monopulse tracking only for single band or dual-band.

SUMMARY

The present invention provides methods and apparatus for a tri-band feed for a reflector antenna having pseudo-monopulse tracking capability. With this arrangement, a compact feed for satellite communication, especially for on the move communication systems, is provided. While exemplary embodiments of the invention are shown and described as having certain frequencies, components, applications and configurations, it is understood that inventive embodiments are applicable to communication applications in general for which multi-band feeds are desirable.

In one aspect of the invention, a feed assembly for a reflector antenna comprises an aperture common to low, mid, and high frequency bands, a polyrod to launch signals in the mid and high frequency bands while supporting the low band, a compact horn to launch signals in the low frequency band, a co-located phase center for launching signals in the low, mid, and high frequency bands, and a low-band monopulse array located on a surface about a perimeter of the aperture to track a satellite.

The feed assembly can further include one or more of the following features: respective beamwidths, e.g., 10-dB, for the low, mid, and high frequency bands are approximately equal, which are about 74° in an exemplary embodiment, the monopulse array includes a four patch antenna array, a waveguide network for the low frequency band is elongated to minimize blockage of the reflector antenna by the feed, a length of a polarizer for the mid and high frequency bands is reduced to minimize the blockage, a length of the feed is less than six inches, a diameter of the aperture is less than 2.5 inches, and the monopulse array is implemented in a single stripline layer.

In another aspect of the invention, a method comprises providing a feed assembly for a reflector antenna, comprising: providing an aperture common to low, mid, and high frequency bands, providing a polyrod to launch signals in the mid and high frequency bands while supporting the low band, providing a compact horn to launch signals in the low frequency band, providing a co-located phase center for launching signals in the low, mid, and high frequency bands, and providing a low-band monopulse array located on a surface about a perimeter of the aperture to track a satellite.

The method can further include one or more of the following features: respective beamwidths, e.g., 10-dB, for the low, mid, and high frequency bands are approximately equal, which are about 74° in an exemplary embodiment, providing the monopulse array to include a four patch antenna array, elongating a waveguide network for the low frequency band to minimize blockage of the reflector antenna by the feed, reducing a length of a polarizer for the mid and high frequency bands to minimize the blockage, a length of the feed is less than six inches, a diameter of the aperture is less than 2.5 inches, and implementing the monopulse array in a single stripline layer.

BRIEF DESCRIPTION OF THE DRAWINGS

The foregoing features of this invention, as well as the invention itself, may be more fully understood from the following description of the drawings in which.

DETAILED DESCRIPTION

Exemplary embodiments of the invention provide a tri-band feed to achieve electronic tracking for satellite communication (SATCOM). It is understood that electronic tracking offers significant advantages over mechanical tracking by increasing the scanning speed of the antenna beam and allowing multiple scans to be performed during a single frequency sync hop. Signal variation, particularly in a COTM (communications on the move) application, can vary over the relatively long scan interval of a mechanical tracking system leading to large tracking errors and increased noise into the tracking loop. By using electronic scanning the scan interval is reduced by an order of magnitude and the effect of signal fading and random disturbances can be greatly reduced.

Exemplary embodiments of the invention provide a compact tri-band feed useful for SATCOM (satellite communication) antennas, for example, that achieves high antenna efficiencies and low sidelobes. In exemplary embodiments, the feed includes a center conductor with a polyrod to launch mid-band and high-band energy into free space. The internal end of the polyrod tapers to a point while the diameter of the center conductor surrounding it gradually increases up to the internal tip of the polyrod in order to support the dominant mode of the mid-band frequency and to provide good impedance match. A compact horn with a taper section and a corrugation launches the low-band and helps shape the patterns of the mid-band and high-band. The tri-band feed also includes co-located phase centers. In one embodiment, the tri-band feed has approximately equal 10-dB beamwidths for the three bands.

In exemplary embodiments, the monopulse feed provides radiating elements for a reflector antenna with multiple beams ($\Sigma$, $\Delta AZ$, and $\Delta EL$) in the downlink band and a single beam in the uplink band. A monopulse network provides monopulse tracking capability.

To add monopulse tracking capability to a tri-band feed with minimal impact on the antenna efficiencies and sidelobes, a four-patch array fed by stripline is provided. The patch radiators and beamforming network are compact and low loss. The beamforming network is traced around the feed using an innovative offset stripline with a low dielectric foam layer to separate the ground plane and drive the field to the higher dielectric layer. The trace layer employs low loss material with a slotted cover to couple to four circularly polarized patches.

Figure 1:
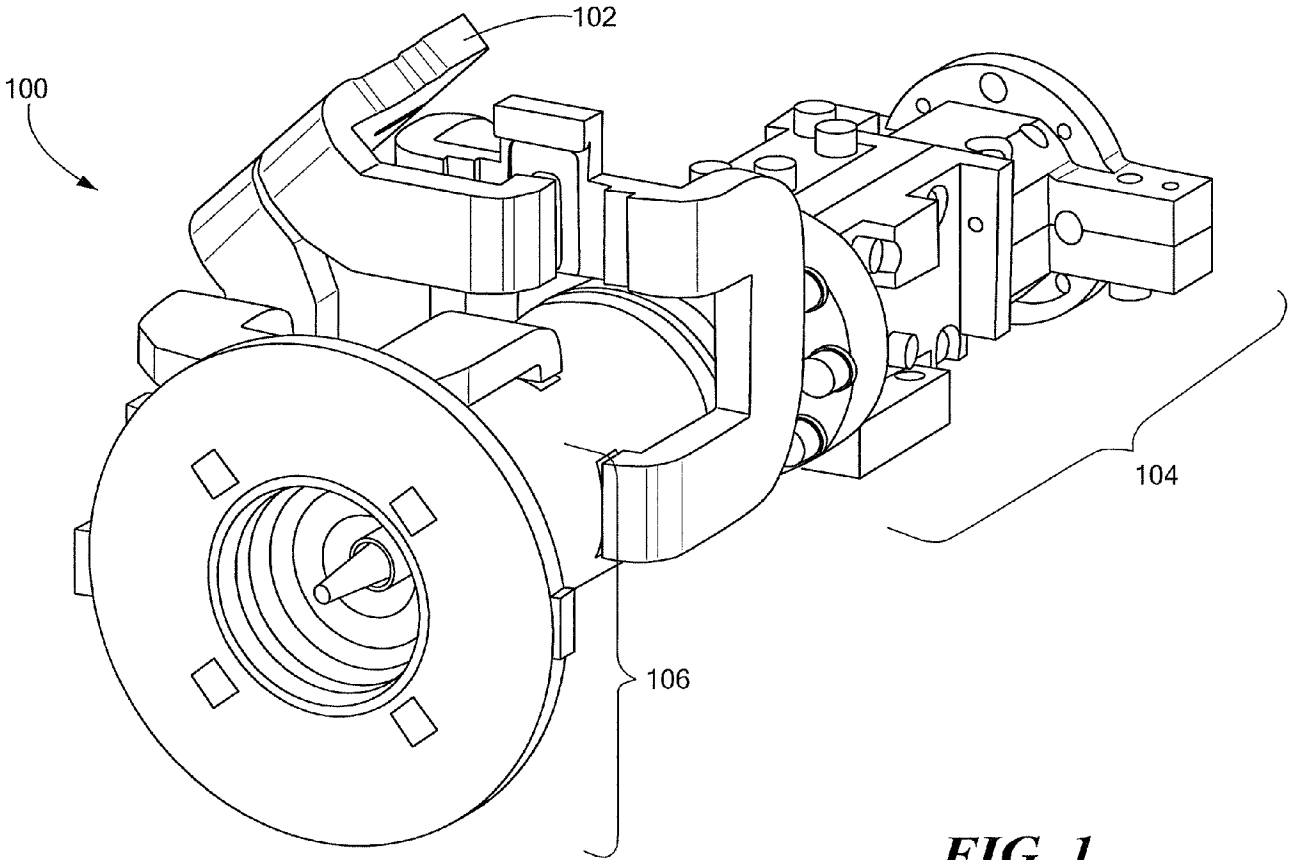
FIG. 1 is an isometric view of a tri-band feed in accordance with exemplary embodiments of the invention.

FIG. 1 shows an exemplary tri-band feed 100 with pseudo-monopulse tracking in accordance with exemplary embodiments. In the illustrative embodiment, the low, mid, and high bands that make up the tri-bands of the feed include K (20.2-21.2 GHz), Ka (30-31 Ghz), and Q (43.5-45.5 GHz) bands. The feed 100 includes a K-band circular polarizer 102 and a Q, Ka band polarizer 104. The face of the aperture includes a monopulse array 106.

Figure 2:
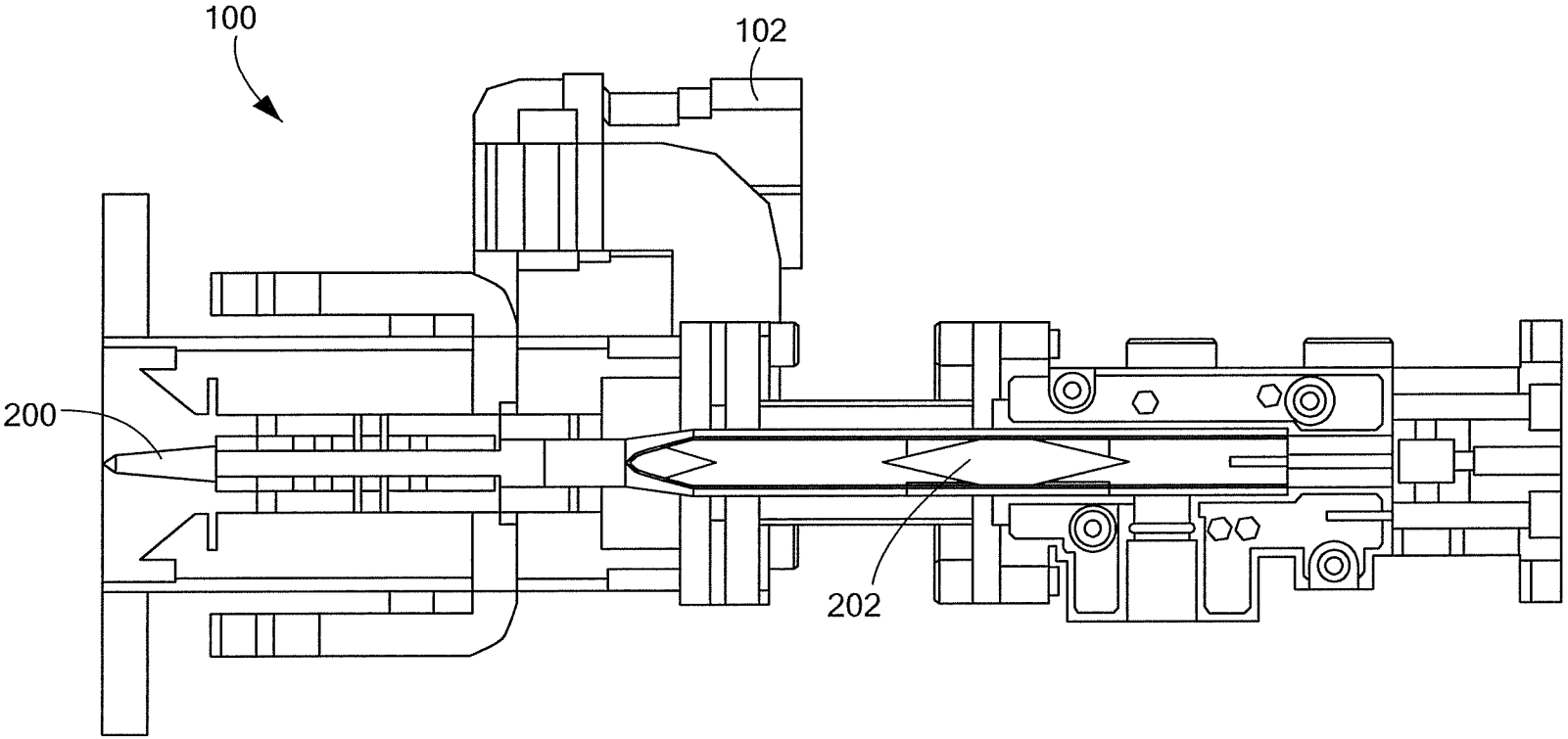
FIG. 2 is a cross-sectional view of the tri-band feed of FIG. 1.
Figure 3:
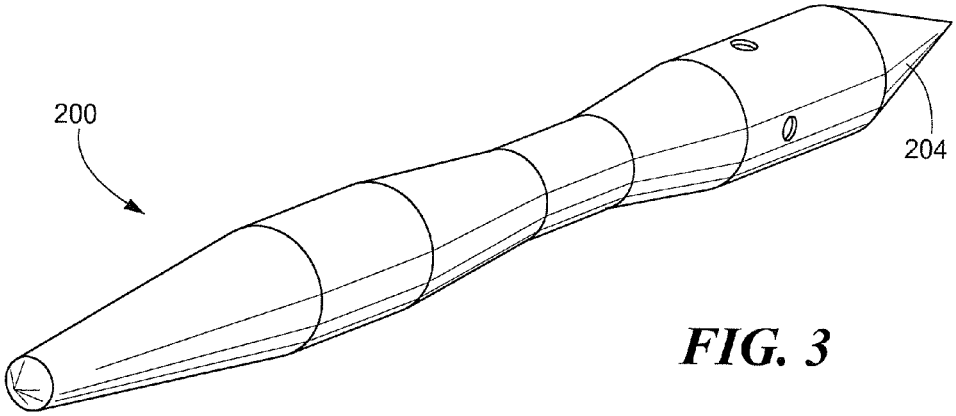
FIG. 3 is an isometric view of the polyrod shown in FIG. 2.

As shown in FIG. 2, the feed 100 includes a center conductor with a polyrod 200 to launch mid-band (Ka) and high-band (Q) energy into the free space and a polarizing vane 202 to convert linear polarization (LP) into circular polarization (CP). As shown in FIG. 3, the internal end 204 of the polyrod tapers to a point while the diameter of the center conductor surrounding it gradually increases at the same time up to the internal tip of the polyrod. The dielectric loading of the center conductor reduces the diameter size needed to support the dominant mode of the mid-band (Ka). The reduction of the center conductor diameter makes the low-band coaxial waveguide and its associated waveguide network possible otherwise, impedance matching at the low-band would be almost impossible. The taper section on the polyrod and waveguide is to ensure a gradual impedance change to avoid a mismatch for both mid and high bands. It is understood that dielectric loading and taper for impedance matching to meet the needs of a particular application is well within the ordinary skill in the art.

Figure 4A:
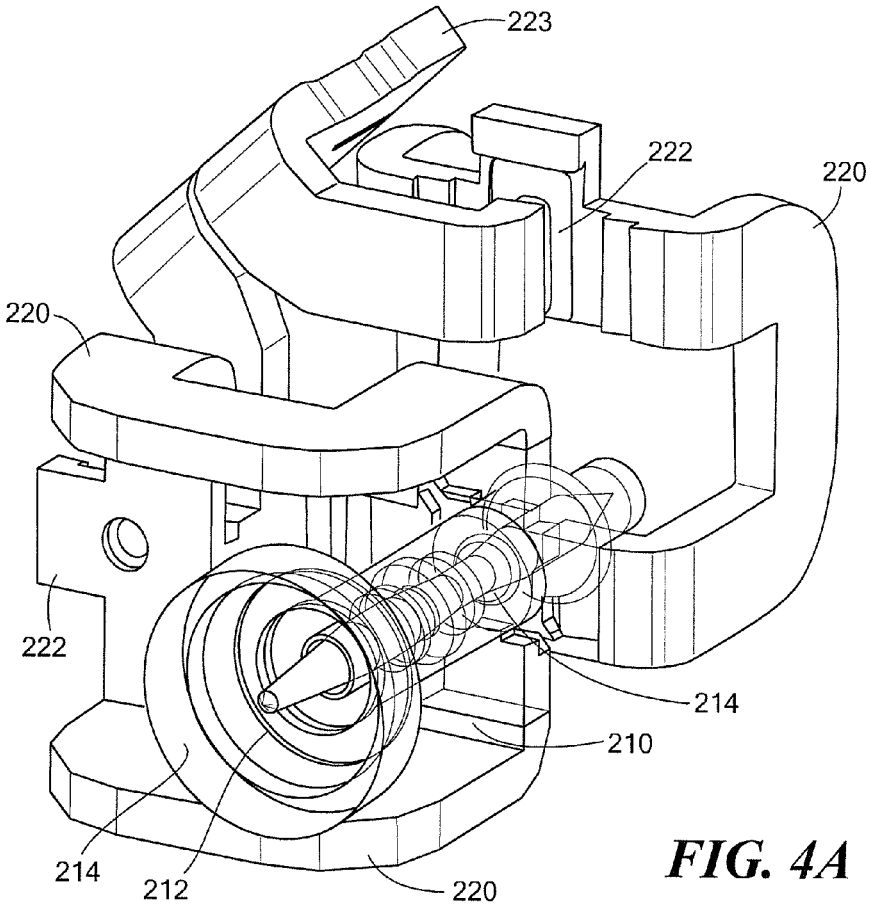
FIGS. 4A-4C show respective isometric, side, and front views of a low-band waveguide network for a tri-band feed.
Figure 4C:
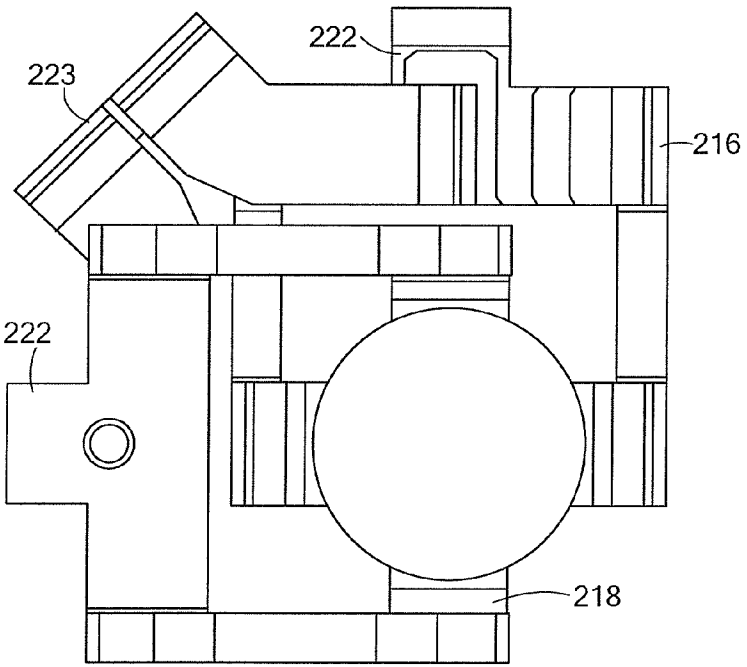
Figure 4B:
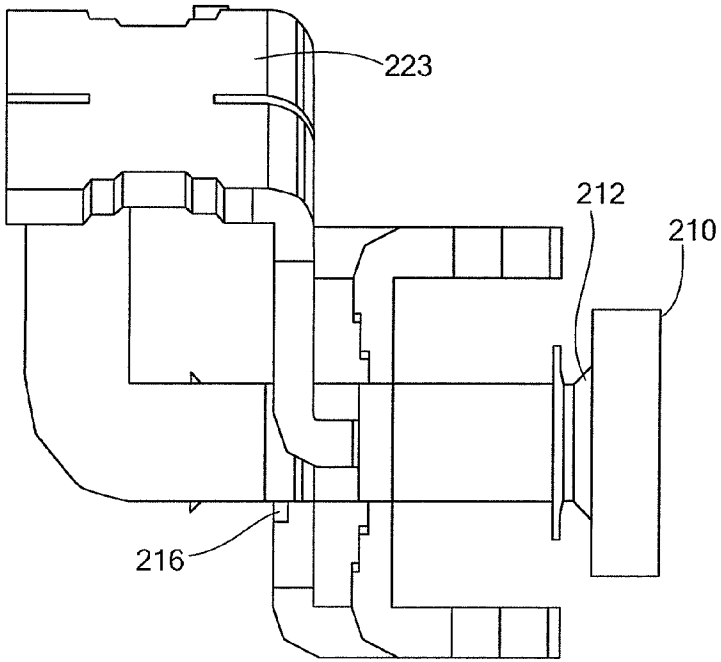

FIGS. 4A-C show a compact horn 210 with a taper section 212 and a single corrugation 214 to launch the low-band (K) energy and also shape the patterns of the mid-band and high-band. A low-band waveguide network 216 includes a coaxial turnstile junction 218, a series of waveguide bends 220, two 180° hybrids 222 and a 90° hybrid 223 to provide a compact, minimized cross section with optimized RF performance. The coaxial turnstile junction 218 allows the low-band energy to be coupled out to four symmetric rectangular waveguide channels with low loss. The symmetry of the structure ensures that generation of higher order modes will be minimal. The two 180° hybrids 222 are used to combine vertical and horizontal channels, and the 90° hybrid 223 converts these two combined signals into RHCP (Right Hand Circular Polarization) and LHCP (Left Hand Circular Polarization) signals. Note that the vertical pairs are bent toward feed horn and the horizontal pairs are bent away before being combined to avoid physical interference.

Figure 5:
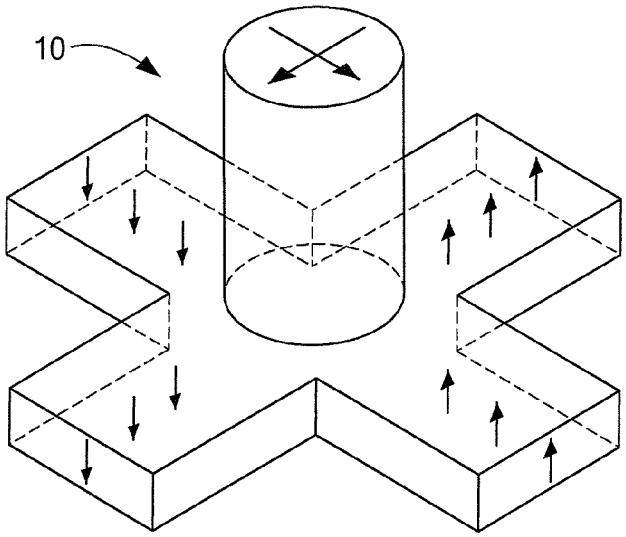
FIG. 5 PRIOR ART
FIG. 5 is a schematic representation of a prior art turnstile junction.
Figure 6:
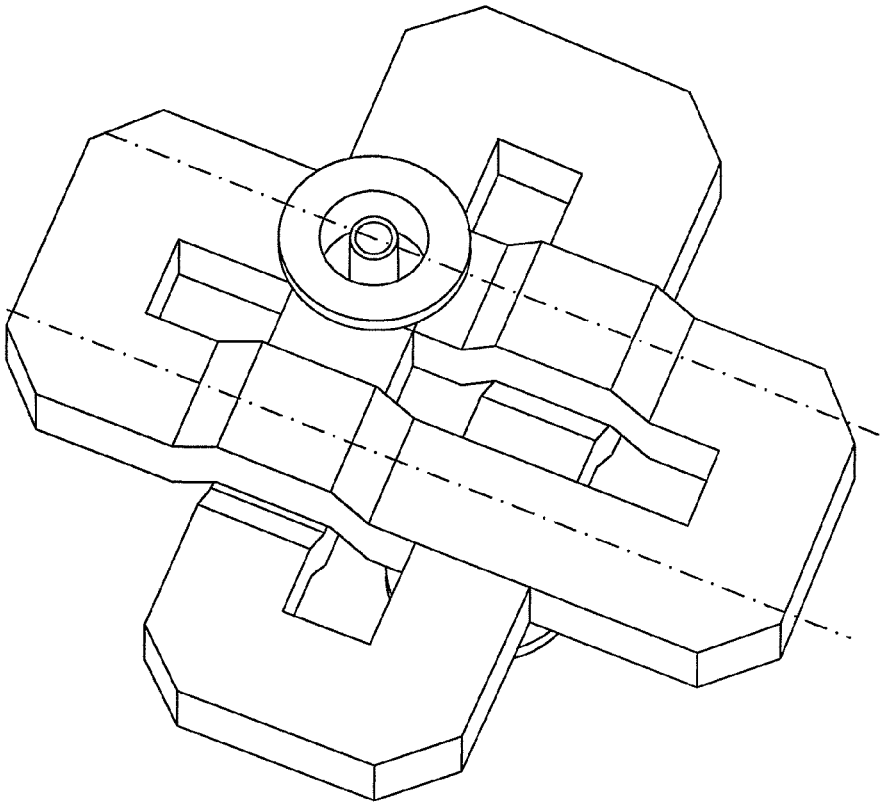
FIG. 6 PRIOR ART
FIG. 6 is a schematic representation of a prior art dual-band orthomode transducer.

FIG. 5 shows an exemplary turnstile junction 10 that can form a part of an orthomode transducer (OMT). The turnstile junction 10 includes four rectangular waveguide ports in a common plane placed symmetrically around and orthogonal to a longitudinal axis of a circular or square main waveguide. FIG. 6 shows an exemplary OMT with a turnstile junction. Exemplary orthomode transducers and turnstiles are shown and described in U.S. Pat. No. 7,397,323, which is incorporated herein by reference.

Figure 7:
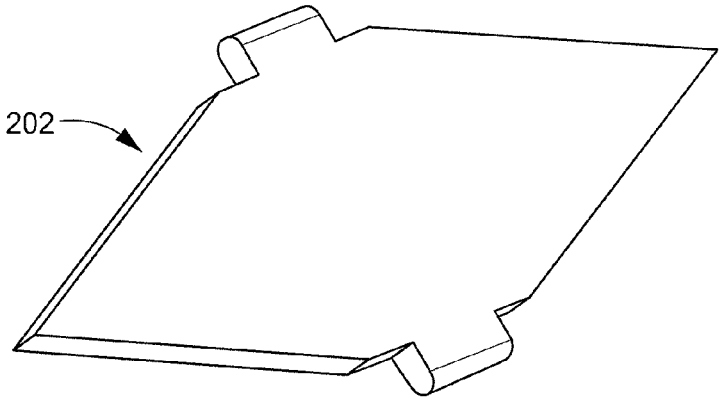
FIG. 7 is a schematic representation of the dual-band (mid and high bands) polarizer shown in FIG. 2.

FIG. 7 shows for the mid-band and high-band the common dielectric vane polarizer 202 of FIG. 2 used in conjunction with a squeezed waveguide section to achieve low axial ratio performance for both mid and high bands. As is known in the art, a squeezed waveguide, using a series of capacitive posts or flat bottom along the floor of the waveguide, provides needed phase differential near the low end of the band to achieve 90° phase shift. Along with a dielectric vane, the squeezed waveguide provides low axial ratio over a wide range of frequency band.

Figure 8:
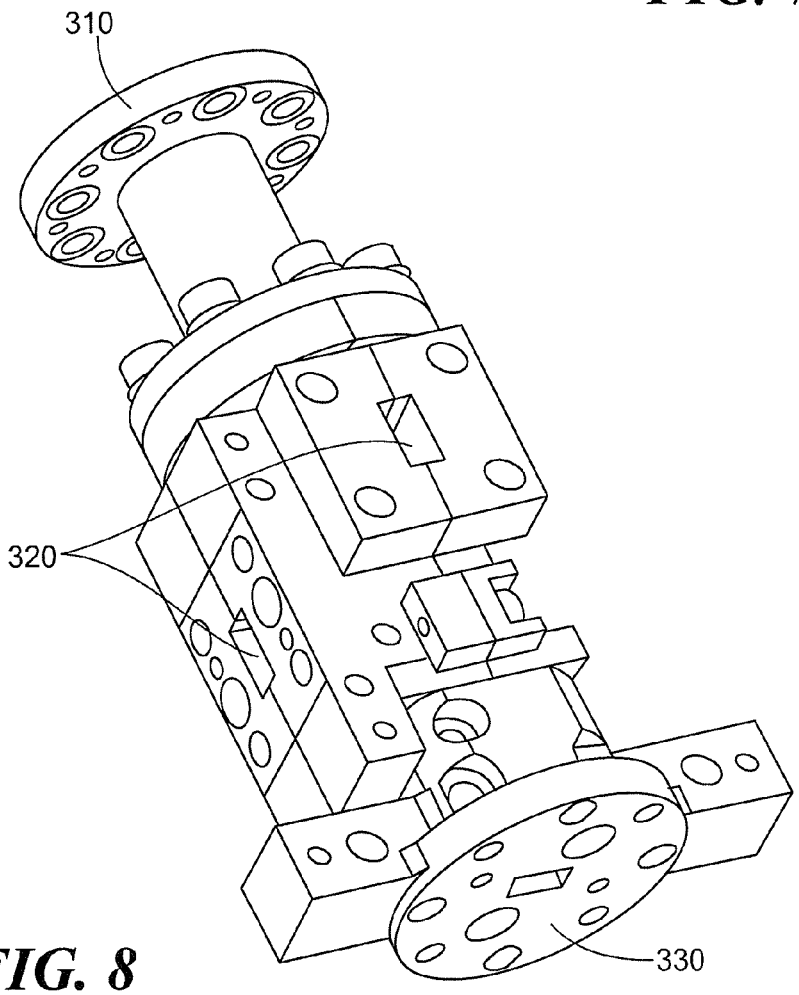
FIG. 8 is an isometric view of the dual-band (mid and high bands) diplexer and orthomode transducer of the tri-band feed shown in FIG. 2.

FIG. 8 shows the back of the feed including a 4-port diplexer to separate two mid-band ports and the high-band port. The diplexer has a common circular (or square) port 310, two orthogonal rectangular mid-band ports 320, and one rectangular high-band port 330. As is known in the art, a waveguide diplexer is a device for combining/separating multi-band and multi-port signals to provide either band or polarization discrimination.

Figure 9:
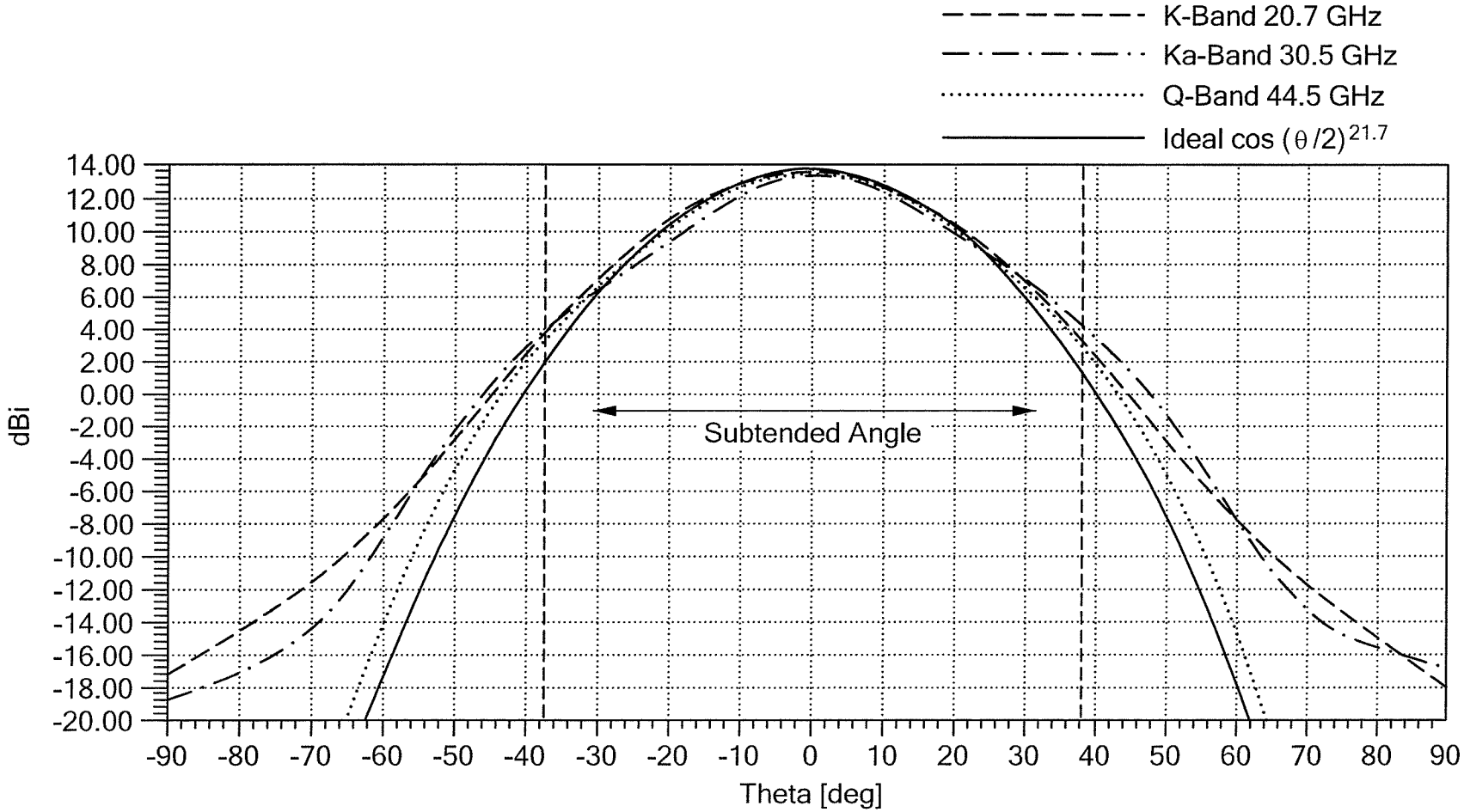
FIG. 9 shows calculated feed patterns at middle frequencies of three bands comparing with an ideal theoretical feed pattern for an example tri-band feed.

In an exemplary embodiment, the tri-band feed has co-located phase centers and approximately equal 10-dB beamwidths for all three bands, as shown in FIG. 9. In the illustrative embodiment, the K-band pattern is for 20.7 GHz, the Ka band is for 30.5 GHz, and the Q band is for 44.5 GHz. Co-location of the feed phase centers for all three bands achieves high phase efficiencies of the antenna for all three bands. Otherwise, a compromised phase center has to be used to place the feed in the tri-band reflector antenna, which will degrade the phase efficiencies depending on the amount of compromise. Likewise, approximately equal 10-dB beamwidths achieve optimized aperture efficiencies of the antenna. Otherwise, illumination efficiencies and spillover losses of the desired three bands have to be compromised.

In an exemplary embodiment, a monopulse four-patch array is provided on the feed aperture. As is known in the art, monopulse antennas can be designed in a variety of configurations. Tradeoffs in feed design are made among optimal sum and difference signals, low sidelobes, multi-band operation, and circular polarization. One type of monopulse feed implementation includes single horn and four horns. A second type is to use single horn with non-symmetrical higher-order modes for the difference signals. The sum signal is received through the dominant waveguide mode. Sum and difference signals are isolated using mode coupling devices eliminating the need for a monopulse comparator.

Figure 10:
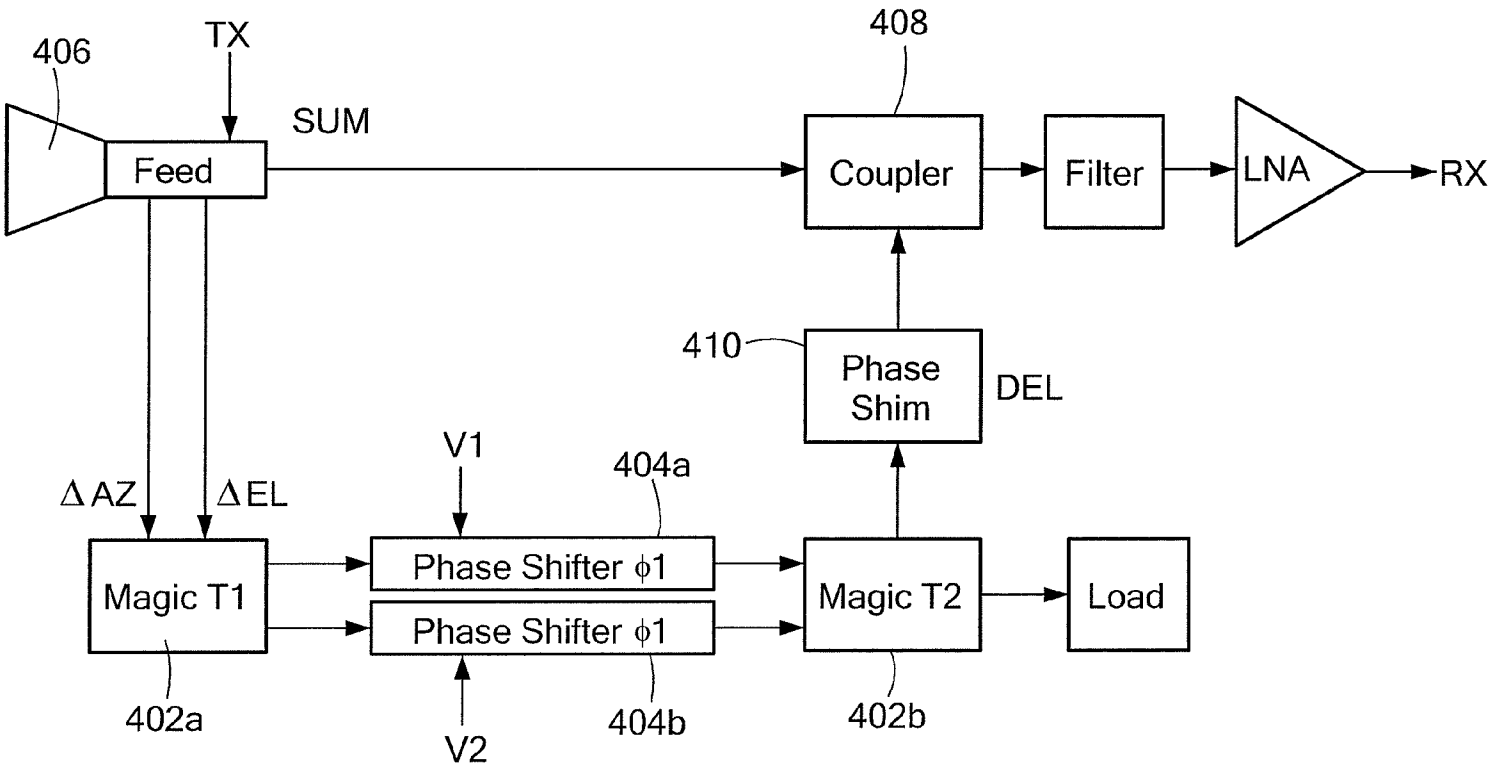
FIG. 10 is a RF block diagram of a pseudo-monopulse feed system.

In one embodiment shown in FIG. 10, the monopulse patch array includes first and second magic tees 402*a,b* and a pair of phase reversers (180° 1-bit phase shifters) 404*a,b*. A horn 406 feeds the first magic 402*a* the ΔAZ and ΔEL signals and provides the SUM (Σ) signal to a coupler 408, which is coupled to the second magic tee 402*b* via a phase shim 410.

By switching the phase of each phase shifter, the antenna beam is sequentially rotated to each quadrant as follows:

$\phi_1=0°\phi_2=0°$, DEL=+ΔEL $\phi_1=180°\phi_2=180°$, DEL=−ΔEL $\phi_1=0°\phi_2=180°$, DEL=+ΔAZ $\phi_1=180°\phi_2=0°$, DEL=−ΔAZ The phase reversers 404 and magic tees 402 can be implemented using waveguide in a manner well known to one of ordinary skill in the art. The ΔEL signal and ΔAZ signal are input to the delta and sum port of the first magic tee 402*a*. The signals then combine and are input into the first and second voltage controlled phase reversers 404*a,b*. The shifted signals then enter the second magic tee 402*b* where the unselected portion is loaded and the phase-selected signal is coupled to the received communication (sum) signal. The phase shim 410 corrects path length differences between the sum and delta arms.

It is understood that the coupler 408 plays a significant role in determining the downlink loss and tracking accuracy. A small coupling coefficient leads to lower downlink loss but less tracking accuracy, while a large coupling coefficient has the opposite effect. In one embodiment, a 13 dB coupler provides a good balance between downlink loss and tracking accuracy.

Figure 11A:
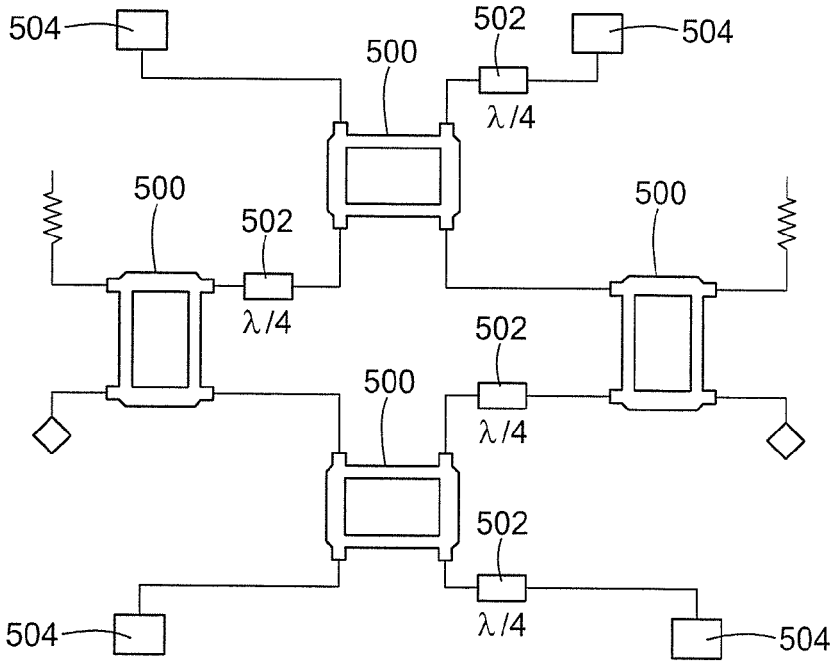
FIG. 11A is schematic representation of a branch line comparator.

In an exemplary embodiment shown in FIG. 11A, the monopulse includes a plurality of branch line couplers 500 and ¼λ phase shifters 502 to feed patch radiators 504 and form the delta patterns. In one embodiment, this is implemented on a single trace layer to allow greater flexibility in feeding the patch radiators 504 for eliminating the need for multilayer vias and probes.

Figure 11B:
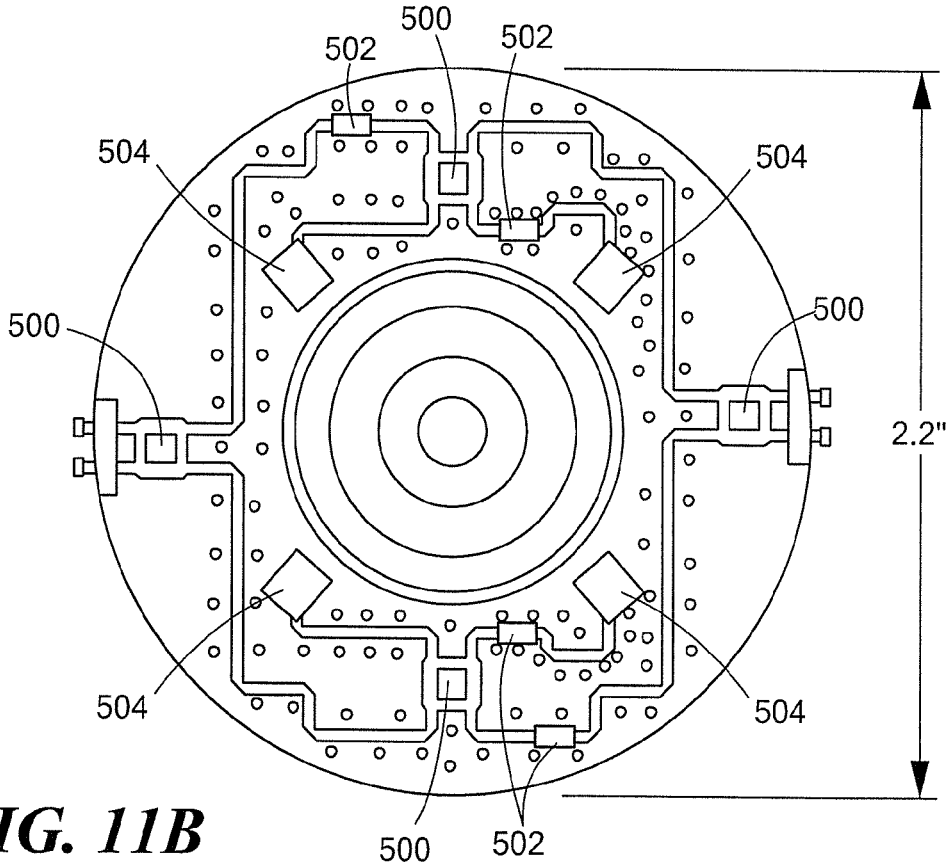
FIG. 11B is a schematic representation of a stripline implementation of the branch line comparator of FIG. 11A for a multi-band feed.

In one embodiment, the patches 504 are placed at the diagonals of the sum horn to reduce the element spacing and reduce grating lobes in the azimuth and elevation planes. FIG. 11B shows a stripline representation of the comparator.

In an exemplary embodiment, the branch line comparator is formed from entirely of passive microwave components. Table 1 lists the layer stack-up used to construct an illustrative comparator. Offset stripline was used to obtain ground plane shielding while still having the ability to use aperture coupled patches. A rigid foam, such as Rohacell PMI foam, with a dielectric close to air ($\epsilon_r$=1.04) was used as a spacer between the trace and ground plane. The foam spacer greatly reduced the loss allowing a low loss, low dielectric substrate, such as Rogers Corporation RT 5880 high frequency laminate, to be used as the trace layer, because the trace has a higher dielectric constant than the foam the majority of the field propagates in the low dielectric layer.

TABLE 1

Monopulse array and comparator layer stack up

| | Layer | $\epsilon_r$ | Loss Tan | Thickness (mils) |
|---|---|---|---|---|
| 8 | Patch | | | 0.675 |
| 7 | Rogers RT 5880 | 2.22 | 0.0009 | 31 |
| 6 | Cover | | | 0.675 |
| 5 | Rogers RT 5880 | 2.22 | 0.0009 | 10 |
| 4 | Trace | | | 0.675 |
| 3 | ROHACELL Foam | 1.04 | 0.0106 | 125 |

TABLE 1-continued

Monopulse array and comparator layer stack up

| | Layer | $\epsilon_r$ | Loss Tan | Thickness (mils) |
|---|---|---|---|---|
| 2 | 3M VSB Adhesive | 2.00 | 0.0400 | 15 |
| 1 | Ground | | | 0.675 |

In one embodiment, the monopulse comparator is traced on inhomogeneous offset stripline. Because the majority of the field propagates on the low loss dielectric substrate it is more similar to a quasi-TEM microstrip line with a substrate height of 10 mils, thus equation 1 was used for a first order approximation of the lines characteristic impedance. HFSS (High Frequency Structural Simulator—a finite element method solver for electromagnetic structures from Ansoft Corporation) was used to calculate the effective dielectric constant and wavelength in the material at 1.92 and 1.06 cm respectively. A line width of 31 mils resulted in a characteristic impedance of 50 Ohms.

$$Z_o = \begin{cases} \dfrac{60}{\sqrt{\varepsilon_s}}\ln\left(\dfrac{8d}{W}+\dfrac{W}{4d}\right) & \text{for } \dfrac{w}{d} \le 1 \\ \dfrac{120\pi}{\sqrt{\epsilon_s}\left[\dfrac{W}{d}+1.393+\left(0.667\ln\left(\dfrac{W}{d}+1.444\right)\right)\right]} & \text{for } \dfrac{w}{d} \ge 1 \end{cases} \quad \text{Eq. 1}$$

Figure 12:
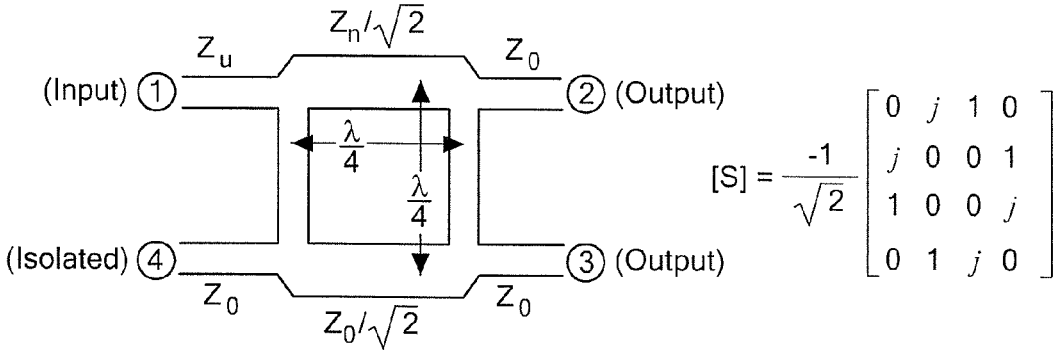
FIG. 12 is a schematic representation of a branch line coupler.

In one embodiment, the branch line coupler is a 3 dB directional coupler with a 90° phase difference between the output ports. As shown in FIG. 12, the coupler can be constructed using quarter wavelength lines with impedances of $Z_o$ and $Z_o/\sqrt{2}$, where $Z_o$ is the characteristic impedance of 50 Ohms. In operation of the branch line coupler power entering port 1 is evenly split with a 90° phase difference between ports 2 and 3. Port 4 is isolated and receives no power.

In an exemplary embodiment, the monopulse array includes four patch radiators tuned at low band to receive and form delta azimuth and elevation signals. Aperture coupled patches provide more design flexibility and lower manufacturing tolerances over a traditional probe fed patch. Using aperture-coupled patches enables independent optimization of the trace/feed layer, elimination of feed radiation, and increased bandwidth.

Figure 13:
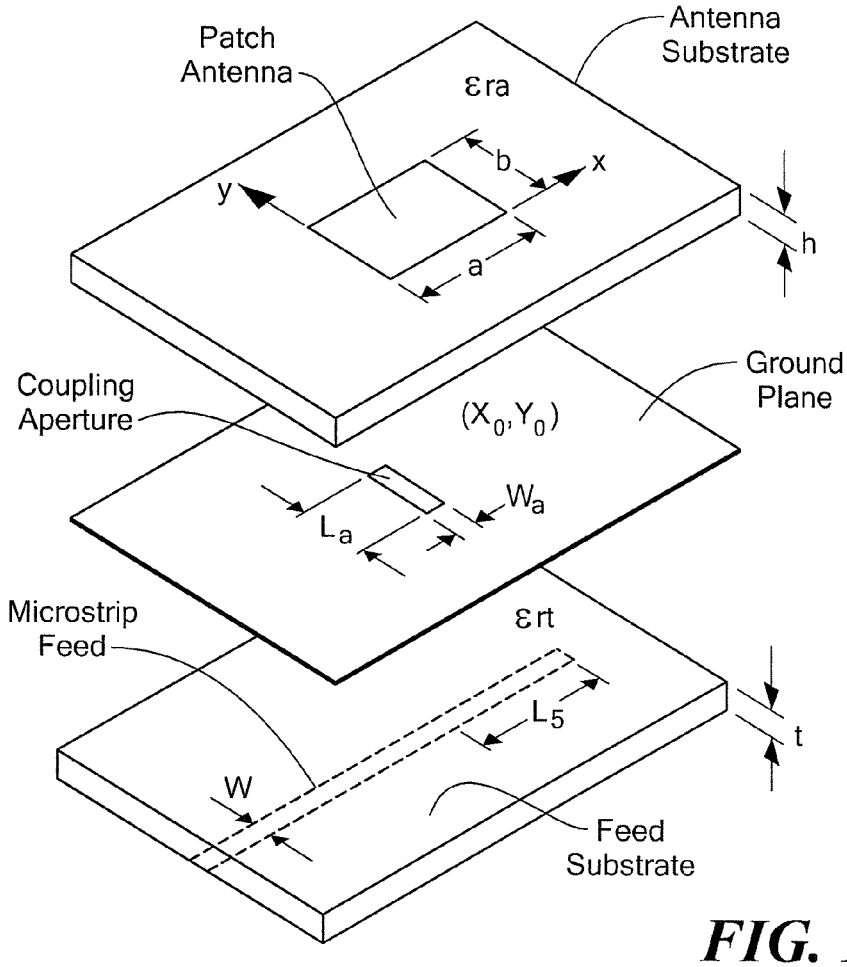
FIG. 13 is an exploded view of an aperture coupled patch radiator.

FIG. 13 shows an exemplary aperture-coupled patch including a minimum of three layers; the first layer is the trace substrate, followed by a slotted cover, and finally the patch substrate. Generally the coupling aperture is placed in the center of the patch to maximize coupling and reduce cross-polarization.

Figure 14:
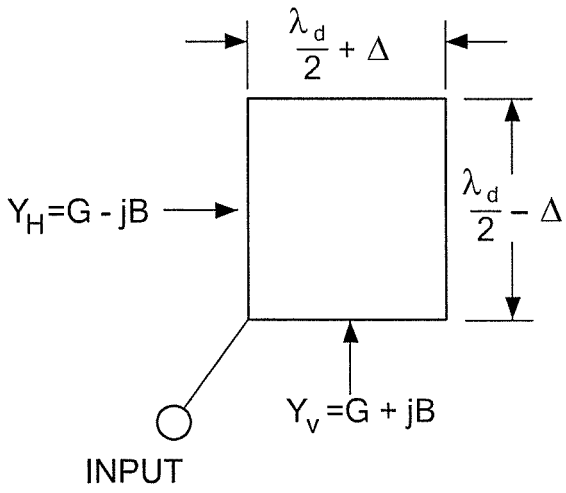
FIG. 14 is a schematic representation of a single fed patch with circular polarization.

The general form of the aperture-coupled patch was adapted for circular polarization and stripline feeding. Crossed rectangular slots were used to excite both the $TM_{100}$ and the $TM_{010}$ mode. A perturbation Δ was introduced along the patch sides as illustrated in FIG. 14 to create a phase difference of 90° between the two modes. The combination of the two modes produces a dual tuned response. Stripline feeding was accomplished by using an offset stripline stack-up as listed in Table 1 above. The stripline was traced on low loss dielectric, e.g., Rogers 5880, and separated from the ground plane by a 125-mil layer of foam. By using foam with a lower dielectric constant than the low dielectric, e.g., Rogers 5880, the offset geometry allowed the field to propagate in the higher dielectric and couple to the patches.

Figure 15B:
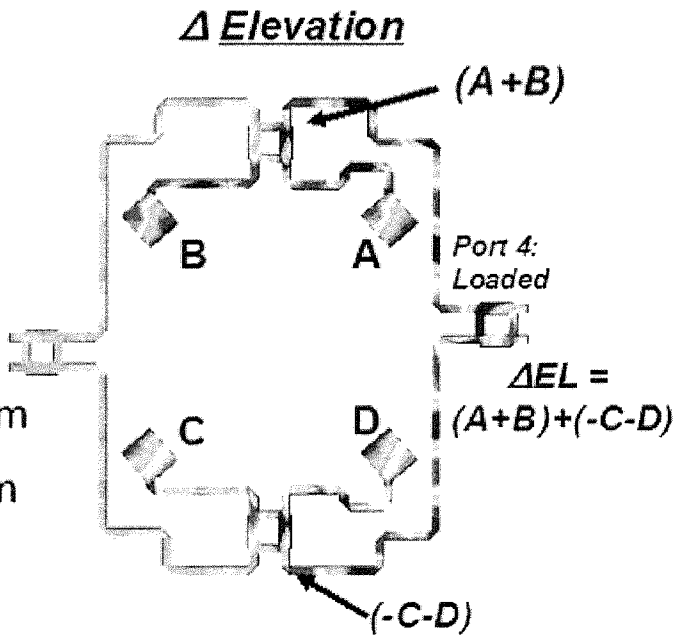
FIG. 15 is a schematic representation of branch line comparator operation.
Figure 15A:
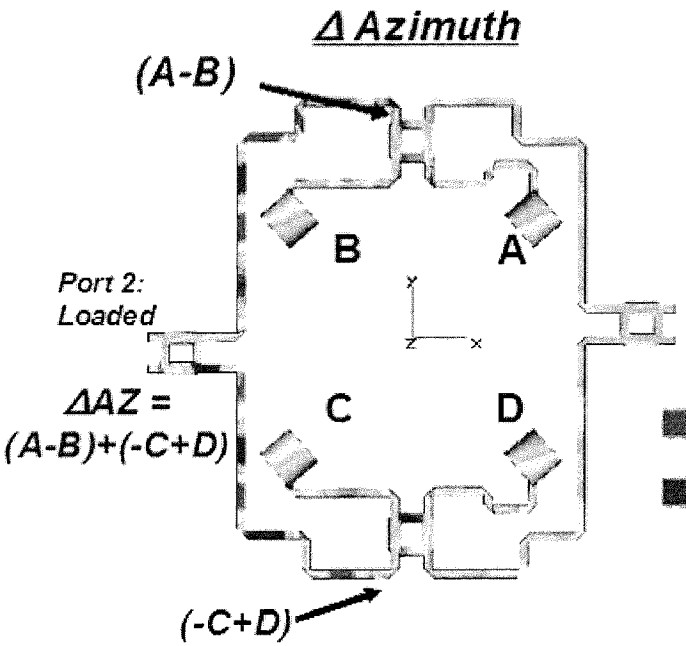

FIG. 15 shows the branch line comparator using ¼λ phase shifts and branch line couplers to shape the received field to form delta azimuth and delta elevation signals.

The four patch radiators are labeled A to D. The delta azimuth fields show patches A and B 180° out of phase and patches C and D 180° out of phase. This phase difference creates a null in the vertical plane producing a total received field of A−B−C+D at the delta azimuth port. Similarly the delta elevation fields show patches A and C 180° out of phase and patches A and D 180° out of phase. This phase difference creates a null in the horizontal plane producing a total received field of A+B−C−D at the delta elevation port. It is also evident that the delta azimuth and elevation ports are isolated.

Figure 16:
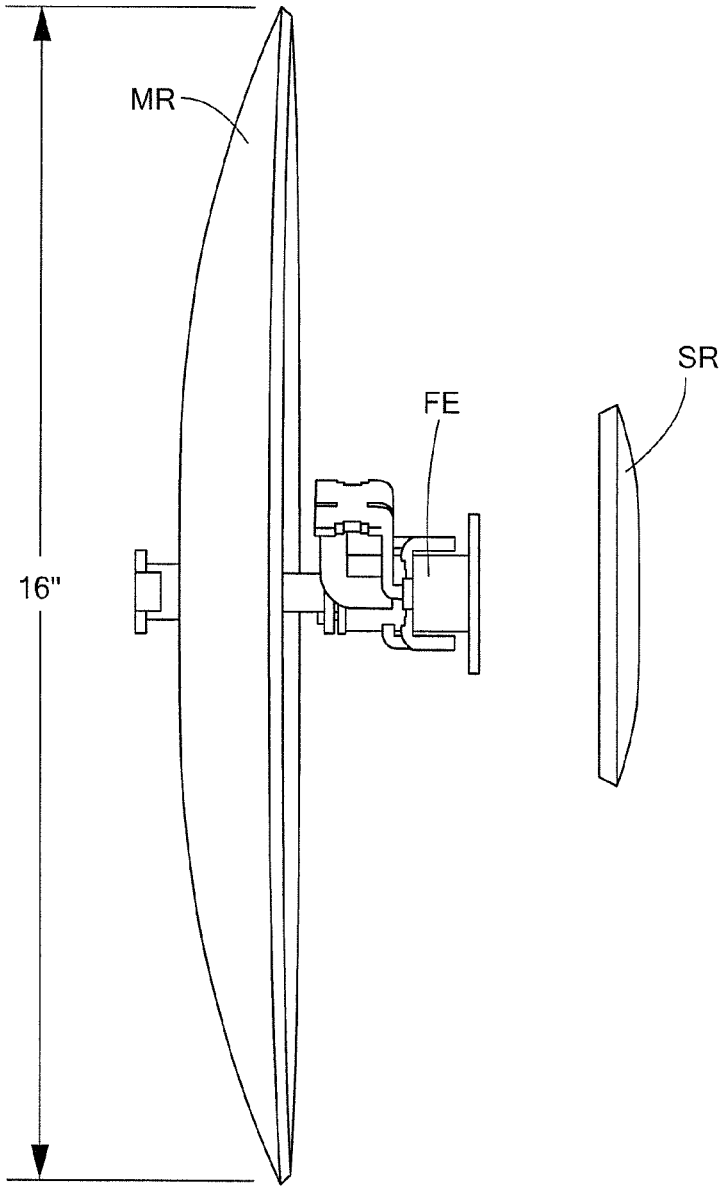
FIG. 16 is a schematic representation of a tri-band feed and reflector antenna.

Since a reflector antenna will be used, as shown in FIG. 16, blockage should be minimized. In an exemplary embodiment, the low band network was elongated and reduced in size, TEM error ports are removed, and the length of the dual band (mid and high) polarizer was reduced to facilitate use of the inventive tri-band feed FE with low profile reflector antennas in COTM applications. Without these design features, the low-band network will block some of the energy between the subreflector SR and main reflector MR and could cause significant blockage loss for the antenna.

In an exemplary embodiment, a tri-band feed is less than about six inches long with an aperture diameter less than about 2.5 inches to minimize blockage. As discussed above, the aperture is common to Q, Ka, K band communication with co-located phase centers with approximately same 10-dB beamwidths for the three bands.

It is understood that while the tri-band feed with monopulse tracking is shown and described in exemplary embodiments as including the K (20.2-21.2 GHz), Ka (30-31 Ghz), and Q (43.5-45.5 GHz), it is understood that other embodiments can include different frequencies to meet the needs of a particular application without departing from the scope of the present invention.

Exemplary embodiments of the present invention provide a tri-band compact feed design that provides superior performance for the three frequency bands and pseudo-monopulse tracking capability. A novel compact and low loss patch array with beamforming network is implemented on a single stripline layer. In addition, the tri-band feed utilizes aperture coupled patches with the inherent radiation isolation of stripline. Further, the inventive tri-band feed provides a significant increase in tracking performance with little impact on antenna efficiency and sidelobes.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A feed assembly for a reflector antenna, comprising:

an antenna aperture common to low, mid, and high frequency bands;

a polyrod to launch signals from the aperture in the mid and high frequency bands while supporting the low band;

a horn to launch signals from the aperture in the low frequency band;

a co-located phase center for launching signals in the low, mid, and high frequency bands; and a low-band monopulse array located on a surface about a perimeter of the aperture to track a satellite.

2. The feed assembly according to claim 1, wherein respective beamwidths for the low, mid, and high frequency bands is approximately equal.

3. The feed assembly according to claim 2, wherein the respective beamwidths are about 10 dB.

4. The feed assembly according to claim 1, wherein the monopulse array includes a four patch antenna array.

5. The feed assembly according to claim 1, wherein a waveguide network for the low frequency band is elongated to minimize blockage of the reflector antenna.

6. The feed assembly according to claim 1, wherein a length of a polarizer for the mid and high frequency bands is reduced to minimize blockage of the reflector antenna.

7. The feed assembly according to claim 1, wherein a length of a feed is less than six inches.

8. The feed assembly according to claim 1, wherein a diameter of the aperture is less than 2.5 inches.

9. The feed assembly according to claim 1, wherein the monopulse array is implemented in a single stripline layer.

10. The feed assembly according to claim 1, wherein the monopulse array provides sum, delta azimuth, and delta elevation beams in a downlink band and a single beam in an uplink band.

11. The feed assembly according to claim 1, further including a turnstile junction coupled to the horn for coupling low-band energy to four symmetric waveguide channels.

12. A method, comprising:

receiving and transmitting signals using a feed assembly for a reflector antenna having an antenna aperture common to low, mid, and high frequency bands;

employing a polyrod to launch signals from the aperture in the mid and high frequency bands while supporting the low band and employing a compact horn to launch signals from the aperture in the low frequency band, wherein a phase center for launching signals in the low, mid, and high frequency bands is co-located; and employing a low-band monopulse array located on a surface about a perimeter of the aperture to track a satellite.

13. The method according to claim 12, further including employing respective beamwidths for the low, mid, and high frequency bands that are approximately equal.

14. The method according to claim 13, wherein the respective beamwidths are about 10 dB.

15. The method according to claim 13, wherein the monopulse array includes a four patch antenna array.

16. The method according to claim 13, further including elongating a waveguide network for the low frequency band to minimize blockage of the reflector antenna.

17. The method according to claim 13, further including reducing a length of a polarizer for the mid and high frequency bands to minimize blockage of the reflector antenna.

18. The method according to claim 13, wherein a length of a feed is less than six inches.

19. The method according to claim 13, wherein a diameter of the aperture is less than 2.5 inches.

20. The method according to claim 13, further including implementing the monopulse array in a single stripline layer.

* * * * *